United States Patent [19]

Brown et al.

[11] 3,978,596

[45] Sept. 7, 1976

[54] SANDALS AND METHOD OF MAKING SAME

[76] Inventors: Dwight C. Brown; Kevin B. Brown, both of 711 1/2 E. Houston, Pasadena, Tex. 77502

[22] Filed: Nov. 24, 1975

[21] Appl. No.: 634,407

Related U.S. Application Data

[63] Continuation-in-part of Ser. No. 526,466, Nov. 25, 1974, Pat. No. 3,928,927.

[52] U.S. Cl. ..... 36/11.5; 12/142 S

[51] Int. Cl.[2] ..... A43B 3/12; A43D 9/00

[58] Field of Search ..... 36/11.5, 44; 12/142 R, 12/142 S

[56] References Cited

UNITED STATES PATENTS

| | | | |
|---|---|---|---|
| 736,194 | 8/1903 | Bassett | 36/11.5 |
| 1,784,035 | 12/1930 | Wilmowsky | 36/11.5 |
| 1,959,382 | 5/1934 | Newton | 36/4 |
| 2,669,036 | 2/1954 | Israel | 36/11.5 |
| 2,761,224 | 9/1956 | Gardiner | 36/11.5 |
| 3,052,045 | 9/1962 | Grimaldi | 36/11.5 |
| 3,121,962 | 2/1964 | Gullo | 36/11.5 |
| 3,352,033 | 11/1967 | Colley | 36/11.5 |
| 3,404,469 | 10/1968 | Prenoritz | 36/11.5 |
| 3,553,754 | 1/1971 | Mendelsohn | 36/11.5 |
| D147,308 | 8/1947 | Steel | 36/11.5 |

*Primary Examiner*—Patrick D. Lawson
*Attorney, Agent, or Firm*—Pravel & Wilson

[57] ABSTRACT

A foot sandal and method for making same, the sandal having a laminated platform having an upper and a lower layer, stirrup strapping members mounted with the platform for securing the platform to the foot with the stirrup strapping members including a loop extending through the upper layer of the laminated platform and a toe securing member adapted to be positioned adjacent toes of the foot for securing the stirrup strapping members adjacent the toe end of the laminated platform to the foot.

22 Claims, 9 Drawing Figures

SANDALS AND METHOD OF MAKING SAME

CROSS-REFERENCE TO RELATED APPLICATIONS

This application is a continuation-in-part of Ser. No. 526,466, filed Nov. 25, 1974, now Pat. No. 3,928,927.

BACKGROUND OF THE INVENTION

The field of this invention is footwear, particularly of the type relating to sandals and methods for making same.

Prior art sandals include those such as disclosed in U.S. Pat. Nos. 3,404,469; 3,352,033; 2,761,224; 2,669,036 and 2,239,471.

Some of the difficulties encountered in sandals generally include straps that may become easily detached from the sole of the shoe becuase of inadequate securing members, sandals that are not resistant to water, and straps that may potentially cause chafing and/or binding against the foot.

SUMMARY OF THE INVENTION

The present invention provides a new and improved sandal, and method for making same, the sandal having a laminated platform conforming substantially to the shape of the sole of the foot and formed of at least two layers, stirrup strap means mounted with the laminated platform for securing the laminated platform to the foot with the stirrup strap means having a loop extending through the upper layer of the laminated platform and toe securing means mounted adjacent the toe end of the laminated platform with the stirrup strap means and adapted to be positioned between adjacent toes of the foot for securing the stirrup strap means adjacent the toe end of the laminated platform to the foot.

DESCRIPTION OF THE PREFERRED EMBODIMENT

Figure 1:
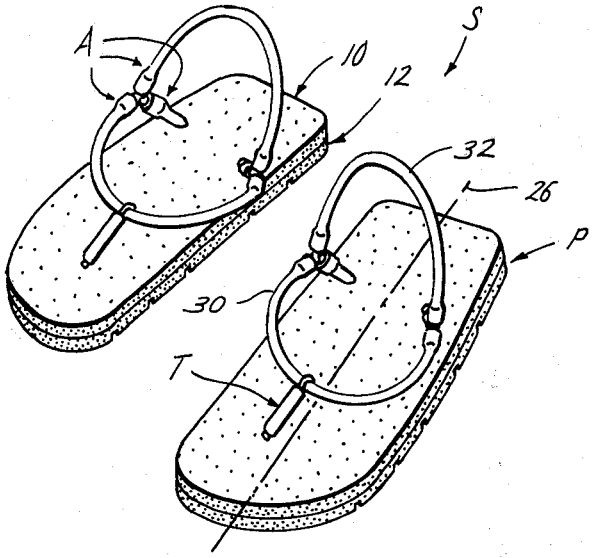
FIG. 1 is an oblique view of the sandals of the present invention as completely assembled.

In the drawings, the letter S designates the sandal of the present invention. The sandal S includes a laminated platform P having stirrup strap means A mounted with the platform P and toe securing means T for securing the stirrup strap means A with the platform P.

The sandal S includes a laminated platform P having an upper layer 10 and a lower layer 12. Preferably, the upper layer 10 is of a vinyl foam such as that marketed under the name "Rubatex" vinyl foam R-326-V, however, other materials, such as polyethylene or rubber foams, may be used. Preferably, the lower layer 12 is of a neoprene foam, however, other materials may be used. It is preferred that the lower layer 12 be of a more durable higher durometer material than the upper layer 10 to provide a wear-resistant sandal sole to prolong the life of the sandal S of the present invention. Further, it is preferred that the upper layer 10 be of a vinyl foam inasmuch as typically, such vinyl foams are softer, of a lower durometer, and more resilient than the more durable, high durometer, long lasting neoprene foam. The vinyl foam of the upper layer 10 is a comfortable, soft material to be fitted adjacent the foot F of a wearer of the sandals S.

Preferably, the laminated platform P is of an approximate thickness of one inch, but it is intended that the platform P not be limited only to thickness of one inch but also to include thickness both greater and lesser than such thickness. Still further, the laminated platform P may include further intermediate layers between the upper layer 10 and the lower layer 12 to increase the overall thickness of the sandal S and/or softness of the sandal S. For example, by forming the laminated platform P having a third layer (not shown) therebetween upper layer 10 and lower layer 12 of a vinyl foam having a density less than that of the upper layer 10, a typically very soft, light-weight material is sandwiched between the upper layer 10 and lower layer 12. The results in the laminated platform P of the sandal S being of a greater thickness but also of greater softness to the foot F of the wearer. Typically, such soft intermediate layers are subject to high rates of deterioration should such soft material be used as a upper layer 10 or a lower layer 12. However, by sandwiching such soft intermediate layers between layers 10, 12, such soft materials are protected from excessive wear while providing comfort for the foot F of the wearer.

The platform P is formed to conform substantially with the shape of the sole of the foot F as is upper layer 10 and lower layer 12. The upper layer 10 has an upper surface **10*a* and a lower surface 10*b* and further includes a toe end 10*c* adjacent the toes 14 of the foot F and a heel end 10*d* adjacent the heel 16 of the foot F. Similarly, the lower layer 12 has an upper surface 12*a* and a lower surface 12*b* and a toe end 12*c* adjacent the toes 14 of the foot F and a heel end 12*d* adjacent the heel 16 of the foot F. Preferably, a plurality of slits 18 are formed in the lower surface 12*b* of the lower layer 12. The slits 18 preferably are formed substantially perpendicular to the longitudinal axis 26 (FIG. 1) of the platform P and extend across the entire width of the second layer 12 but, may be formed in any other desired direction and/or crossing pattern. The slits 18 help prevent slippage upon wet, slick surface and further promote flexible bending of the sandal S as described more fully hereinbelow. Further, the slits 18 help prevent formation of a vacuum therebetween the lower surface 12*b* of the lower layer 12** and the surface which is being walked upon.

Figure 4:
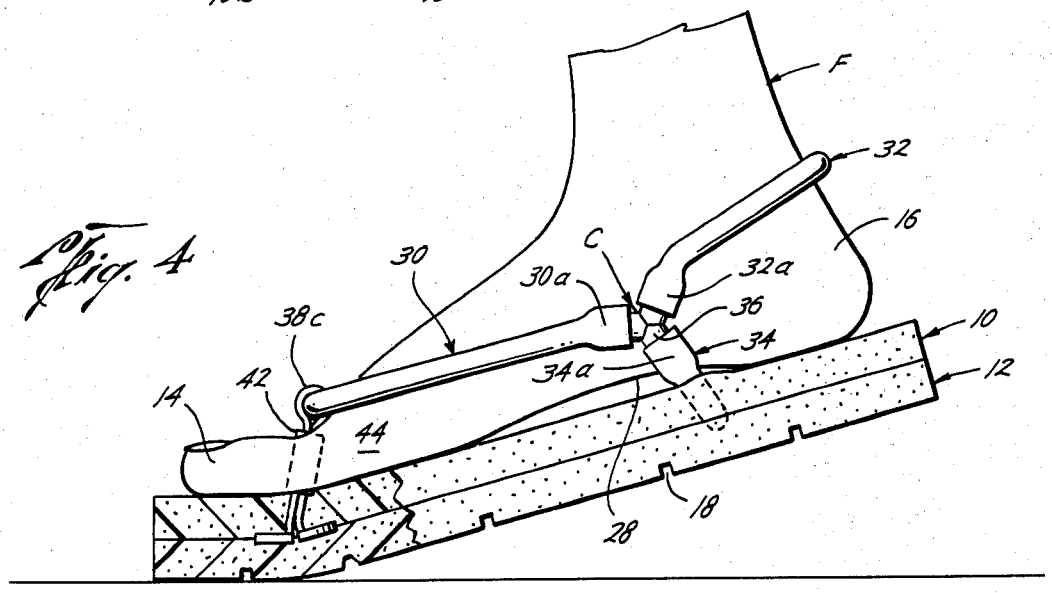
FIG. 4 is a side view of the sandal of the present invention, partially in section, and completely assembled, as fitted to the foot and showing flexing of the toe securing means.

A toe opening 20 is formed in the upper layer 10 adjacent the toe end **10*c* extending therebetween upper surface 10*a* and lower surface 10*b* of the upper layer 10. Heel openings 22, 24 are formed adjacent the heel end 10*d* of the upper layer 10 and extend between the upper surface 10***a* and lower surface 1*b* of the upper layer 10. Preferably, the heel openings 22, 24 are substantially an equal distance from the longitudinal axis 26 (FIG. 1) of the platform P and substantially tranverse thereto. Furthermore, the heel openings 22, 24 are preferably located in the upper layer 10 adjacent to where the arch 28 and heel 16 of the foot F join (FIG. 4).

The laminated platform P of the sandal S of the present invention is secured to the foot F by stirrup strap means A and toe securing means T therewith. The stirrup strap means A includes instep strap means 30, heel strap means 32, and loop or arch strap means 34. Each of such strap means 30, 32, 34 have respectively a first end 30*a*, 32*a*, 34*a* and a second end 30*b*, 32*b*, 34*b*. Preferably, the stirrup strap means A is formed of a protective, cushioned covering or tubing that is soft and preferably waterproof and preferably of a latex, surgical tubing, however, other materials may be used if so desired.

Figure 5:
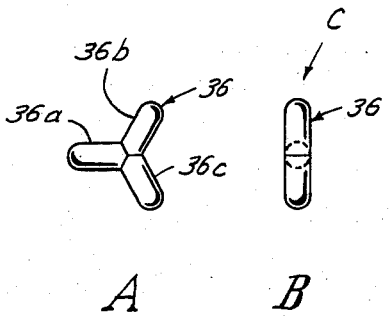
FIG. 5A is a front view of the connector means of the sandal of the present invention.
FIG. 5B is a side view of the connector means of the sandal of the present invention.

Connector means C is mounted with and is for joining together the instep strap means 30, heel strap means 32 and arch strap means 34. The connector means C includes connector 36 (FIGS. 5A, 5B). Preferably, the connector 36 is formed of a flexible polyethylene co-polymer, but suitable other materials may be used, and is of a three-pronged configuration having an instep prong 36*a*, a heel prong 36*b* and an arch prong 36*c*. The connector 36 may be of a substantially Y-configuration as shown in FIG. 5A or of a T-configuration (not shown) or of any other suitable, desired configuration. Preferably, the prongs 36*a*, 36*b*, 36*c* have a slightly greater diameter than that of the inside diameter of strap means A such that the appropriate end portion of such instep, heel, and arch strap means 30, 32, 34 may be forced or stretched onto the appropriate prongs 36*a*, 36*b*, 36*c* of the connector 36 for a tight, frictional engagement therebetween as discussed more fully hereinbelow.

Figure 6:
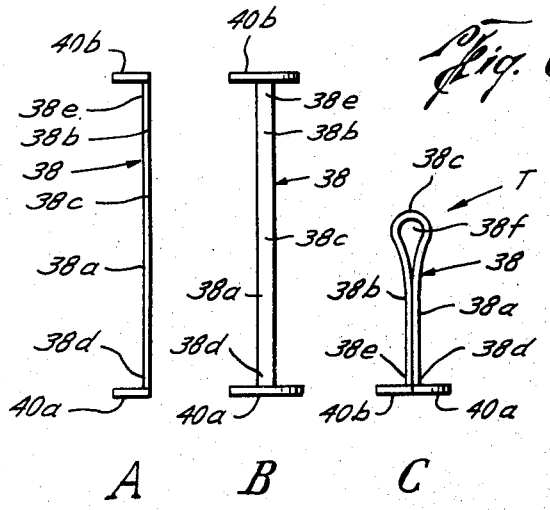
FIG. 6A is a side view of the toe securing means of the sandal of the present invention.
FIG. 6B is a front view of the toe securing means of the sandal of the present invention; and, FIG. 6C is a side view of the toe securing means of the sandal of the present invention in its overlapped position.

The toe securing means T of the present invention includes an elongate portion 38 (FIGS. 6A, 6B, 6C) formed of legs 38*a*, 38*b* joined by an overlapped portion 38*c*. Each of the legs 38*a*, 38*b* has an end portion 38*d*, 38*e*, respectively. Securing portion 40 including portions 40*a*, 40*b* are preferably formed adjacent end portions 38*d*, 38*e*, in preferably a semi-circular configuration, however, any other suitable configuration may alternatively be used. Toe securing means T is preferably formed of a flexible, polyethylene copolymer and capable of being injection molded, however, may be formed of and by any other suitable material or method. It is preferred that the toe securing means T is of a single-piece construction with the elongate portion 38 and securing portion 40 being formed simultaneously. A toe cushioning 42 may be mounted with legs 38*a*, 38*b* of the elongate portion 38 for preventing chafing between toes 14 adjacent thereto. Preferably, the toe cushioning 42 is of a flexible, soft, waterproof material such as latex surgical tubing.

Figure 2:
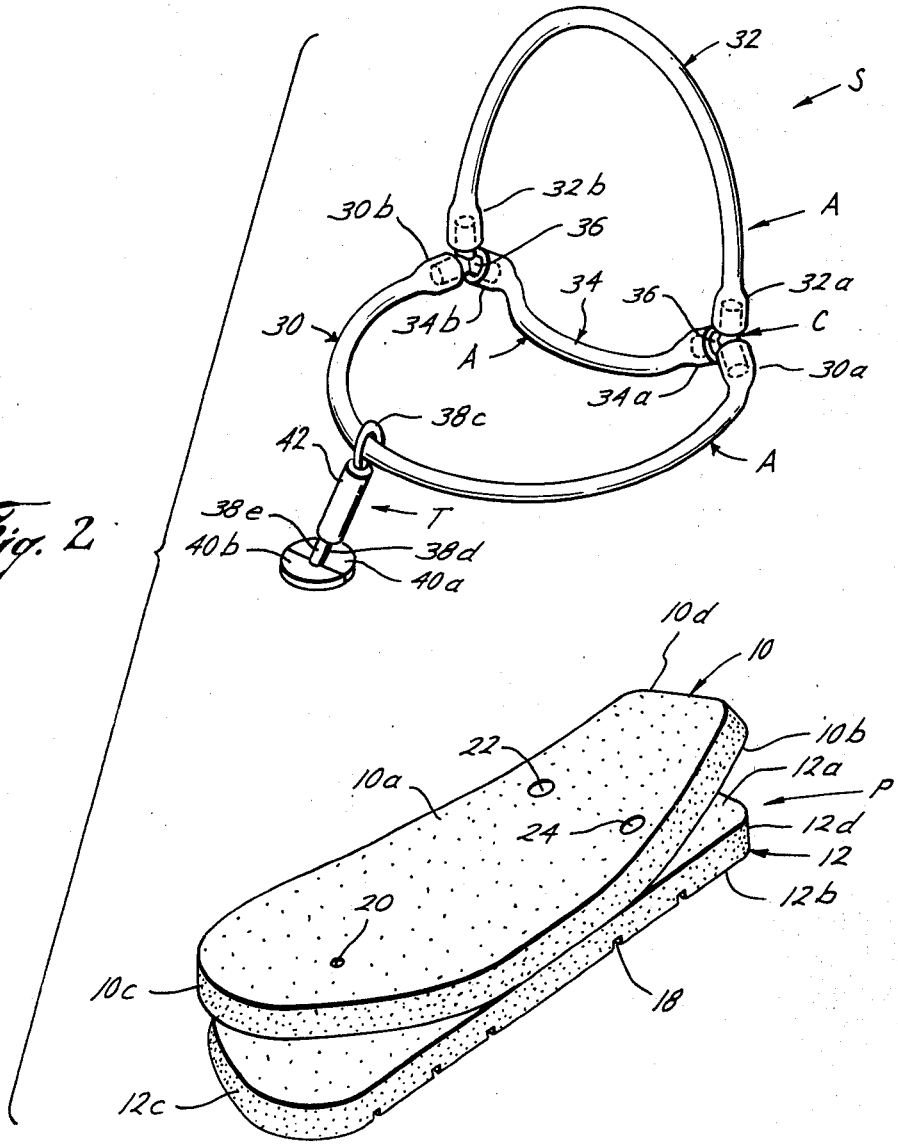
FIG. 2 is an exploded, isometric view of the sandal of the present invention.
Figure 3:
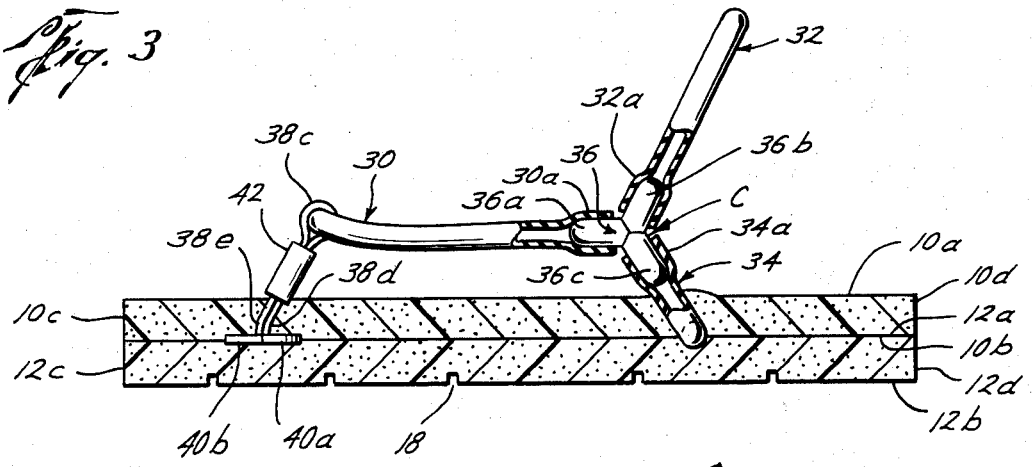
FIG. 3 is a side view, partially in section, of the sandal of the present invention.

In practicing the method of this invention, the upper layer 10 is formed conforming to the shape of the sole of the foot F with toe opening 20 and heel openings 22, 24 formed therebetween the upper surface 10*a* and lower surface 10*b* of the upper layer 10. The toe securing means T is mounted with the upper layer 10 by overlapping the elongate portion 38 at overlapped portion 38*c* and inserting the overlapped portion 38*c* into toe opening 20 from the lower surface 10*b* of the first layer 10 and extending therethrough the toe opening 20 and therefrom the upper surface 10*a* of the upper layer 10 such that the legs 38*a*, 38*b* and the overlapped portion 38*c* extend above the upper surface 10*a* of the upper layer 10. Thereafter, toe cushioning 42 is inserted over the overlapped portion 38*c* and positioned upon the adjacent legs 38*a*, 38*b* as shown in FIGS. 2, 3 and 4.

The loop or arch strap means 34 is mounted with the first layer 10 by inserting first end 34*a* through heel opening 24 and second end 34*b* through heel opening 22 from the lower surface 10*b*, therethrough openings 24, 22, respectively, and extending therefrom upper surface 10*a* of the upper layer 10. It will be appreciated that the order in which the toe securing means T and arch strap means 34 is mounted with the upper layer 10 is of no consequence. Thus, the order of assembly may be alternated such that the arch strap means 34 may be mounted with the upper layer 10 prior to mounting the toe securing means T with the upper layer 10, or vice versa. However, it is important that the toe cushioning 42 be positioned about the toe securing means T after the toe securing means T is appropriately mounted within toe opening 20.

At this point, the instep strap means 30 is mounted with the toe securing means T by inserting one end, such as end 30*a* of the instep strap means 30 through the opening 38*f* (FIG. 6) formed by the overlapped portion 38*c* of the elongate portion 38 and approximately centering the toe securing means T on the instep strap means 30. Thereafter, interconnection of the stirrup strap means A is effectuated by connecting means C. More specifically, connector 36 is used to join the instep strap means 30 and arch strap means 34 and mount heel strap means 32 therewith. The order in which the respective instep, heel and arch strap means 30, 32, 34 are mounted with the connector prongs 36*a*, 36*b*, 36*c*, respectively, is immaterial. Thus, the end portions 30*a*, 32*a*, 34*a* of the instep strap means 30, heel strap means 32, arch strap means 34, respectively, are forced onto the connector prongs 36*a*, 36*b*, 36*c*, respectively. Inasmuch as the connector prongs 36*a*, 36*b*, 36*c* are of a slightly greater diameter than the inside diameter of the stirrup strap means A, the connector 36 frictionally engages such stirrup strap means A and permits minor adjustment of the relative lengths of the stirrup strap means A by means of movement of the ends of such stirrup strap means A along the prongs of the connector 36. More significant adjustments are accomplished by merely cutting off a portion of the appropriate stirrup strap means A with scissors or the like.

Thereafter, the lower layer 12, being formed to conform with the sole of the foot F in similar fashion as upper layer 10, is affixed to the upper layer 10 to finish the sandal. It will be appreciated that if it is desired that the laminated platform P of the sandal S of the present invention be of more than two layers, more layers may be added therebetween upper layer 10 and lower layer 12. The layers 10, 12 or any intermediate thereof may be bonded together by use of an appropriate adhesive substance, glue, or the like. Thereafter, the final sandal S may be refined by suitable finishing the laminated platform P by any machining process such as use of a belt and/or dish sander. Furthermore, the slits 18 may at this point be formed with the lower surface 12*b* of the lower layer 12.

In the use or operation of the sandal S of the present invention, it should be noted that most of the exposed components are easily replaceable without destroying the utility of the sandal S of the present invention. For example, the instep strap means 30 and heel strap means 32 are easily replaceable as is the toe cushioning 42, upon removal of the instep strap means 30. Furthermore, the loop or arch strap means 34 is removable even after the sandal S is in its fully assembled state without requiring the ungluing of the upper layer 10 and lower layer 12 of the laminated platform P. The removal of the loop or arch strap means 34 is accomplished by removing the connector 36 from ends 34*a*, 34*b*. Thereafter, a replacement arch strap means 34 (not shown) is forced into the existing arch strap means 34 as far as is possible. This is typically one-third to one-half of the overall length of the replacement arch strap means 34. Due to frictional resistance between the replacement arch strap means and the existing arch strap means 34, the existing arch strap means 34 may be pulled from the opposite-non-inserted end with a resultant new arch strap means being appropriately pulled into place and threaded into the old, worn arch strap means' previous position, without necessitating disassembly of the upper layer 10 and lower layer 12. Thereafter, the old, worn arch strap means is removed from the replacement arch strap means 34 and the new arch strap ends 34*a*, 34*b* are reconnected to the connector 36.

It should be noted that the loop or arch strap means 34, due to its particular positioning and location on the platform P, provides an arch for the foot to help facilitate proper arch support of the foot F.

As shown in FIG. 4, a further important feature of the toe securing means T is its flexible nature. The flexibility of the toe securing means T, particularly adjacent the end portions 38*d*, 38*e* and securing portions 40*a*, 40*b*, respectively, is significant to the durability of the sandal S. During normal wear of the sandal S of the present invention, typically such sandal S flexes about the toe end of the platform P upon the wearer taking a step with his foot F. The flex of the sandal S adjacent the toe end is accommodated by movement of the toe securing means T by the securing portions 40 flexing about an axis substantially perpendicular to the longitudinal axis 26 of the laminated platform P for preventing undue stress concentrations adjacent the toe end of the laminated platform P. Thus, when a step is taken, securing portions 40*a* and 40*b* can move angularly and laterally with respect to one another to accommodate such flexure in the sandal S, as do slits 18, thus preventing undue wear adjacent this portion of the sandal S due to the securing portion 40.

Inasmuch as the sandal S of the present invention is preferably constructed of vinyl foam, neoprene foam, polyethylene polymers, and latex surgical tubing, the sandal S of the present invention results in an extremely light-weight, waterproof sandal S. Furthermore, although the upper layer 10 of the platform P is initially of a substantially flat configuration of the upper surface 10*a* thereof, after a short period of use, the upper surface 10*a* of the upper layer 10 of the laminated platform P tends to compress in the areas adjacent the heel 16 and ball 44 of the foot F since the bulk of the weight of an individual is carried on these key points of the foot F. Thus, the upper surface 10*a* conforms to the elevational configuration of the sole of the foot F after a short period of use resulting in an extremely comfortable sandal S having a footprint-shaped compression set in the vinyl foam conforming substantially to the sole of the foot F. Still further, the stirrup strap means A being of the latex tubing prevents chafing of the foot F in any areas adjacent thereto when wearing the sandal S of the present invention.

The foregoing disclosure and description of the invention are illustrative and explanatory thereof, and various changes in the size, shape and materials as well as in the details of the illustrated construction may be made without departing from the spirit of the invention.

We claim:

1. A sandal adapted to be worn on the foot, comprising:

a laminated platform conforming substantially to the shape of the sole of the foot and including a toe end and a heel end, said laminated platform having an upper layer and a lower layer;

stirrup strap means mounted with said laminated platform for securing said platform to the foot, said stirrup strap means including:

instep strap means for extending over the instep of the foot;

heel strap means for extending around the heel of the foot; and, arch strap means for extending beneath the arch of the foot;

three pronged connector means for adjustably joining said arch strap means, instep strap means and said heel strap means together; and toe securing means for connecting said toe end of said laminated platform with said instep strap means, said toe securing means adapted to be positioned between adjacent toes of the foot.

2. The sandal of claim 1, wherein:

said stirrup strap means is formed of a flexible surgical tubing.

3. The sandal of claim 2, wherein:

said tubing frictionally engages said connector.

4. The sandal of claim 1, wherein:

said connector is of a substantially Y-configuration.

5. The sandal of claim 1, wherein:

said connector is of a substantially T-configuration.

6. The sandal of claim 1, wherein:

said arch strap means provides an arch support to enhance proper support for the foot.

7. The sandal of claim 1, further including:

toe cushioning mounted with said toe securing means to prevent chafing between toes adjacent thereto, said toe cushioning being of a flexible tubing.

8. A sandal adapted to be worn on the foot, comprising:

a laminated platform conforming substantially to the shape of the sole of the foot and including a toe end and a heel end, said laminated platform having an upper layer and a lower layer;

stirrup strap means mounted with said laminated platform for securing said platform to the foot; and, toe securing means for connecting said toe end of said laminated platform with said stirrup strap means, said toe securing means comprising:

an elongate portion extending through said upper layer and having an overlapped midportion being overlapped about said stirrup strap means; and, end securing portions formed at opposite ends of said elongate portion and tranverse thereto and adapted to be disposed between said upper layer and said lower layer of said platform to secure said elongate portion to said laminated platform.

9. The sandal of claim 8, wherein:

said toe securing means is flexible.

10. The sandal of claim 9, wherein:

said securing portions are disposed on opposite sides of an axis substantially perpendicular to the longitudinal axis of said laminated platform to thereby facilitate flexing of said toe securing means with said laminated platform along said transverse axis.

11. The sandal of claim 8, further including:

toe cushioning mounted with said elongate portion to prevent chafing between toes adjacent thereto, said toe cushioning being of a flexible tubing.

12. A method for making sandals, comprising the steps of:

forming an upper layer of a laminated platform to conform to the shape of the sole of the foot;

inserting an overlapped portion of a toe securing means adjacent the toe end of the laminated platform from the lower surface of the upper layer through the upper layer to mount the toe securing means with the upper layer of the laminated platform;

placing a toe cushioning over the toe securing means extending from the upper surface of the upper layer;

mounting stirrup strap means having an arch strap loop extending through the upper layer wherein said mounting of the stirrup strap means includes the steps of:

inserting the ends of the arch strap loop adjacent the heel end of the laminated platform from the lower surface of the upper layer through the upper layer;

threading the instep strap means between the tow cushioning and the overlapped portion of the toe securing means; and, connecting each end of the instep strap means, a heel strap means, and the arch strap loop together with a connector;

forming a lower layer of the laminated platform to conform to the shape of the foot; and, affixing the upper layer with the lower layer of the laminated platform to finish the sandal.

13. The method of claim 12, wherein said connecting further includes the steps of:

inserting one end of the instep strap means onto the connector;

inserting one end of the heel strap means onto the connector; and, inserting one end of the arch strap loop onto the connector for providing an adjustable, frictionally engaging connection therebetween the instep strap means, heel strap means and arch strap loop.

14. The method of claim 12, further including the step of:

replacing the arch strap loop after the upper layer and lower layer have been affixed together.

15. The method of claim 14, wherein said replacing includes the steps of:

removing the connector from each end of the existing arch strap loop;

inserting a replacement arch strap loop partially into one end of the existing arch strap loop;

pulling the other end of the existing arch strap loop to withdraw the same while pulling the replacement arch strap loop into position;

removing the existing arch strap loop from the replacement arch strap loop; and connecting the ends of the replacement arch strap loop to each connector.

16. A sandal adapted to be worn on the foot, comprising:

a laminated platform conforming substantially to the shape of the foot and including a toe end and a heel end, said laminated platform having an upper layer and a lower layer;

an arch strap loop mounted between said upper layer and said lower layer of said platform and extending upwardly through said upper layer of said laminated platform adjacent said heel end for extending beneath the arch of the foot;

heel strap means for extending around the heel of the foot;

instep strap means for extending over the instep of the foot;

a pair of three-pronged connectors wherein each of said connectors is adjustably connected one end of each of said arch strap loop, and heel strap means and said instep strap means; and, toe securing means mounted adjacent said toe end of said upper layer of said laminated platform, said toe securing means including:

a securing portion disposed between said upper layer and said lower layer of said laminated platform;

a flexible loop having one end extending upwardly through said upper layer of said laminated platform adjacent said toe end overlapping said instep strap means with the other end of said loop mounted with said securing portion; and, toe cushioning means surrounding said loop between the upper layer of said laminated platform and said instep strap means for preventing chafing between the toes.

17. The sandal of claim 16, wherein:

said strap means and said toe cushioning means are formed of surgical tubing.

18. A sandal adapted to be worn on the foot, comprising:

a laminated platform conforming substantially to the shape of the sole of the foot and including a toe end and a heel end, said laminated platform having an upper layer and a lower layer, with said upper layer having a pair of spaced openings formed therein;

stirrup strap means for securing said platform to the foot, said stirrup strap means having a continuous arch loop disposed between said upper layer and lower layer of said laminated platform, with said arch loop extending through said spaced openings; and, toe securing means for connecting said toe end of said laminated platform with said stirrup strap means, said toe securing means adapted to be positioned between adjacent toes of the foot.

19. The sandal of claim 18, wherein said stirrup strap means includes:

instep strap means for extending over the instep of the foot and mounted with said toe securing means adjacent said toe end of said laminated platform;

heel strap means for extending around the heel of the foot; and, connector means for connecting said arch loop, instep strap means and said heel strap means together.

20. The sandal of claim 19, wherein said connector means includes:

at least one three-pronged connector adapted to adjustably connect said arch loop, said instep strap means and said heel strap means together.

21. The sandal of claim 20, wherein:

said stirrup strap means if formed of a flexible surgical tubing; and, said tubing frictionally engages said connector.

22. A sandal adapted to be worn on a person's foot comprising:

a laminated platform conforming substantially to the shape of the sole of a person's foot and including a toe end and a heel end, said laminated platform having an upper layer and a lower layer secured together;

flexible tubular means for securing said laminated platform to a person's foot including:

a first strap adapted to extend over the upper side of the foot;

a second strap adapted to extend behind the heel of the foot; and, a third strap adapted to extend beneath the arch of the foot and through a pair of spaced openings in the upper layer of said laminated platform;

a pair of three-pronged connecting members adapted to be inserted into the open ends of each of said tubular straps for adjustably securing adjacent ends of each of said first, second and third straps together on opposite side of the foot; and, means adapted to extend between the toes of the foot for connecting said first strap to the forward toe portion of said laminated platform intermediate the ends of said first strap.

* * * * *